US005307592A

United States Patent [19]

Wylde

[11] Patent Number: 5,307,592

[45] Date of Patent: May 3, 1994

[54] LENS SURFACE FORMER AND POLISHING TOOL

[76] Inventor: Stephen J. Wylde, 22 Bath Road, Emsworth, Hampshire, England, P010 7EP

[21] Appl. No.: 848,871

[22] Filed: Mar. 10, 1992

[30] Foreign Application Priority Data

May 24, 1991 [GB] United Kingdom ..... 9111349

[51] Int. Cl.[5] ..... B24B 13/06; B24B 1/00; B24D 17/00

[52] U.S. Cl. ..... 51/101 LG; 51/358; 51/284 R

[58] Field of Search ..... 51/284 R, 262 R, 101 LG, 51/216 LP, 127, 33 W, 109 R, 72 R, 358; 82/11.1, 12, 123

[56] References Cited

U.S. PATENT DOCUMENTS

| | | | |
|---|---|---|---|
| 3,699,721 | 10/1972 | Beasley | 51/358 |
| 3,782,042 | 1/1974 | Strasbaugh | 51/58 |
| 3,863,543 | 2/1975 | Böttcher et al. | 51/127 |
| 4,038,783 | 8/1977 | Rosenthal | 51/284 R |
| 4,063,390 | 12/1977 | Chevalier | 51/284 R |
| 4,274,232 | 6/1981 | Wylde | 51/358 |
| 4,394,099 | 7/1983 | Santinelli | 51/101 LG |
| 4,733,502 | 3/1988 | Braun | 51/284 R |
| 5,027,560 | 7/1991 | Coburn et al. | 51/284 R |
| 5,095,660 | 3/1992 | Dillon | 51/284 R |
| 5,140,782 | 8/1992 | Mecteau et al. | 51/284 R |

FOREIGN PATENT DOCUMENTS

| | | | |
|---|---|---|---|
| 0035939 | 9/1981 | European Pat. Off. | 51/101 LG |
| 1297614 | 11/1972 | United Kingdom . | |
| 1346781 | 2/1974 | United Kingdom . | |
| 1524672 | 9/1978 | United Kingdom | 51/284 R |

*Primary Examiner*—Bruce M. Kisliuk
*Assistant Examiner*—Bryan Reichenbach
*Attorney, Agent, or Firm*—Jacobson, Price, Holman & Stern

[57] ABSTRACT

A lens surface former and polishing tool of one-piece construction and made, for example, of aluminium, aluminium alloy or a zinc-based alloy with one side surface of the block being of convex form and the other side surface of the block being of concave form, in which, projecting radially from the cylindrical peripheral surface of the main part of the block, is an annular flange or ledge which is interrupted at equi-distant points by four tapered location grooves or slots extending longitudinally of the tool so as to be parallel to the longitudinal axis of the tool, the flange or ledge with its tapered grooves or slots thereby permitting the tool to be quickly mounted on holding means forming part of a lens-grinding or lens-generating machine.

12 Claims, 4 Drawing Sheets

LENS SURFACE FORMER AND POLISHING TOOL

This invention relates to a lens surface former and polishing tool, that is to say, a tool which is able to combine the function of allowing an optical surface to be formed or generated on a lens with the subsequent function of being used to polish the lens.

GB-A-1,297,614 shows, in FIG. 4, a lens surface former which can be releasably held in a lens-generating machine in order to produce an optical surface on a lens. In the particular lens surface former shown in that Figure, one side of the former has a convex surface while the opposing side has a concave surface. Further, V-section grooves are provided in the cylindrical periphery of the former so that it can be held in the machine by gripping fingers on a collet.

The lens surface former of the above specification thereby allows a desired contour on a lens blank to be generated by the machine through the use of a pair of power-driven rotatable holders, one for releasably holding the lens surface former and the other for releasably holding the lens blank. A freely-rotatable follower wheel traces the contour of the lens surface former as the latter rotates while a power-driven lens-grinding or lens-cutting wheel is arranged to generate a surface on the lens blank which corresponds exactly to the surface of the lens surface former traced by the follower wheel.

GB-A-1,297,614 states that the lens surface former is preferably made of a hard substance such as a hard epoxy resin, a high-grade steel, or some other hard metal or hard synthetic plastics material which can stand up to a good deal of contact with other mechanical means without wearing.

In GB-A-1,346,781, which is a Patent of Addition to GB-A-1,297,614, there are illustrations of slightly different lens surface formers which can be used in the lens-generating machine of the parent Patent. Thus, FIG. 3 in GB-A-1,346,781 shows a lens surface former having convex surfaces on opposite sides of the tool, while FIG. 4 and FIG. 5 show lens surface formers having concave surfaces on opposite sides of the tool. As in the lens surface former shown in FIG. 4 of the parent Patent, these other lens surface formers each have one or more grooves in their peripheral surfaces so that they can be releasably held on the lens-generating machine.

GB-A-1,346,781 also explains that the lens surface formers described therein can be used for both a lens-generating function and also a lens-polishing function. Thus, one surface of the tool can be used to produce an approximate contour on a lens blank as in a lens-grinding or lapping operation, while the other surface of the tool can be used to bring the said contour on the lens blank up to the desired accuracy and to polish it.

The present invention constitutes a development of, and an improvement in, the lens surface formers and polishing tools disclosed in the two prior specifications discussed above with a view to facilitating use of the tool in a machine.

From one aspect, the invention is directed to a lens surface former and polishing tool comprising a block of material having lens-generating or lens-forming surfaces on opposite sides of the block, wherein a laterally-projecting flange or ledge, or a plurality of laterally-projecting flanges or ledges, is or are formed on the block to act as securing means for securing it on a lens-generating machine or a lens-polishing machine, there being location grooves or slots formed in, or formed by, the flange(s) or ledge(s) on the block.

Preferably, the location grooves extend longitudinally of the tool, that is to say, parallel to its axis of rotation, and are of tapered form. In addition, one or more of the grooves is, or are, of different widths from the other groove or grooves. This permits the grooves to co-operate with tapered holding elements of unequal width for axis location on a lens-polishing machine. It has been found in practice that four equi-distant location grooves on the periphery of the tool—two of one width and the other two of a different width—give excellent results.

The laterally-projecting flange or ledge—or each such flange or ledge—will normally be formed integrally of the block. The block can be cast, moulded or machined to its final shape and can be made of any one of a number of different materials. Preferably, it will be made of aluminium, aluminium alloy, or a zinc-based alloy. It is however possible for it to be made of brass, steel, epoxy resin or some other hard synthetic plastics material.

The flange or ledge—or each flange or ledge—on the block will normally have upper and lower surfaces which extend radially of the longitudinal axis of the block.

The invention is not concerned solely with the shape and construction of the lens surface former and polishing tool alone. It also extends to holders for the tool, which holders can be used on lens-generating machines and lens-polishing machines. Similarly, the invention extends still further to lens-generating machines and lens-polishing machines provided with holders for lens-surface formers and polishing tools of the shape and construction described above.

An example of a lens surface former and polishing tool in accordance with the invention is shown in the accompanying drawings, along with illustrations of holders for holding the tool and holding the lens blank on a lens-grinding machine or a lens-polishing machine. In these drawings.

Figure 1:
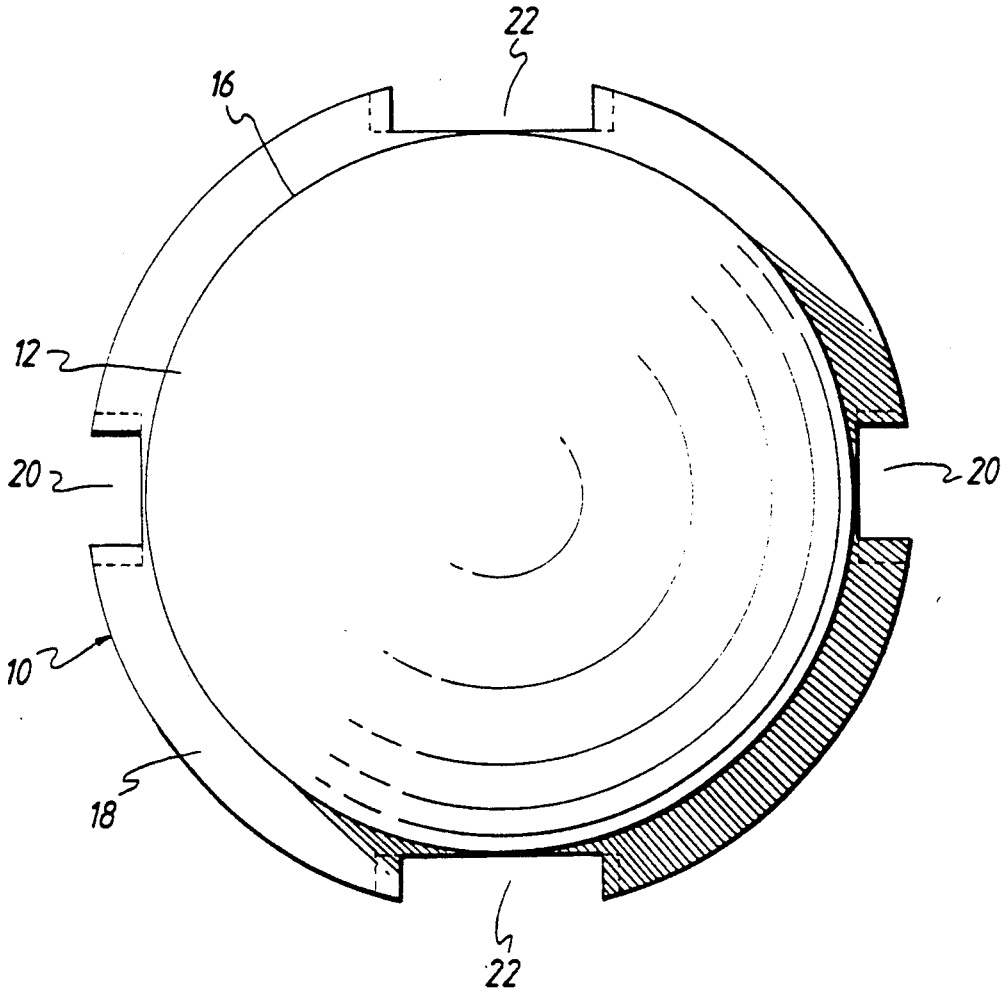
FIG. 1 is a plan view of the lens surface former and polishing tool.
Figure 2:
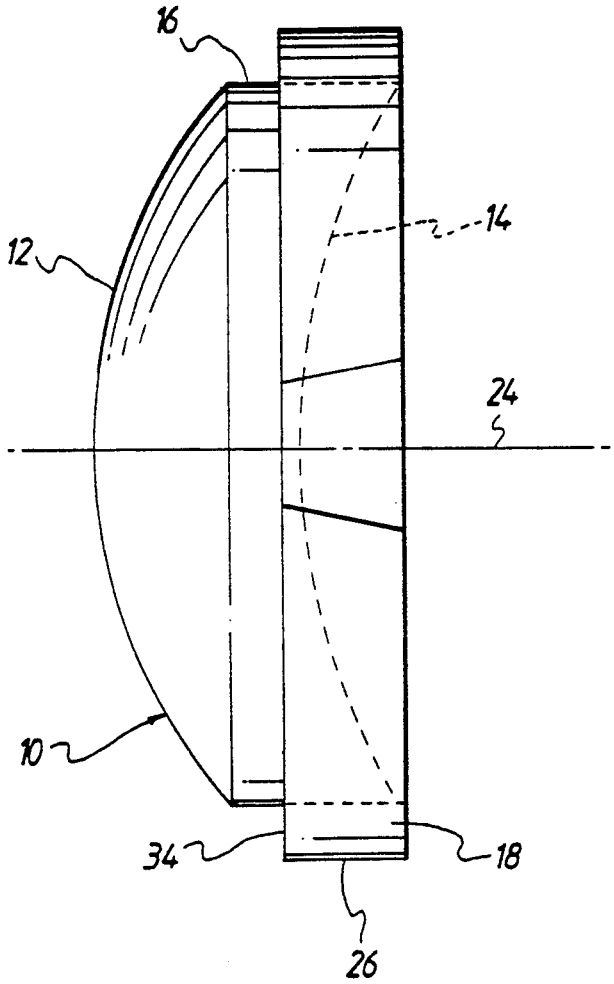
FIG. 2 is a side view of the tool shown in FIG. 1.

The lens surface former and polishing tool 10 shown in FIGS. 1 and 2 is of one-piece construction in that it is moulded, cast or machined so as to form a solid block of material. It may be made of aluminium, aluminium alloy, or a zinc-based alloy. These are the preferred materials. It is however possible for the material of the block to be brass, steel, epoxy resin or some other hard synthetic plastics material.

One side surface 12 of the block is of convex form while the other side surface 14 of the block is of concave form. One surface can then be used in a lens-generating or lens-grinding machine to form an optical contour on a lens blank, while the other surface of the tool can be used in a lens-polishing machine to bring the generated surface on the lens blank to the desired accuracy. It is to be understood that the two surfaces 12 and 14 could equally well be both convex or both concave should that be desired.

Projecting radially from the cylindrical peripheral surface 16 of the main part of the block is an annular flange or ledge 18 which is interrupted at equi-distant points by four tapered grooves 20, 22 extending longitudinally of the tool, that is to say, parallel to the longitudinal axis 24 of the tool. It will be noted that the opposing grooves 22 are of a different width from the other opposing grooves 20.

Figure 3:
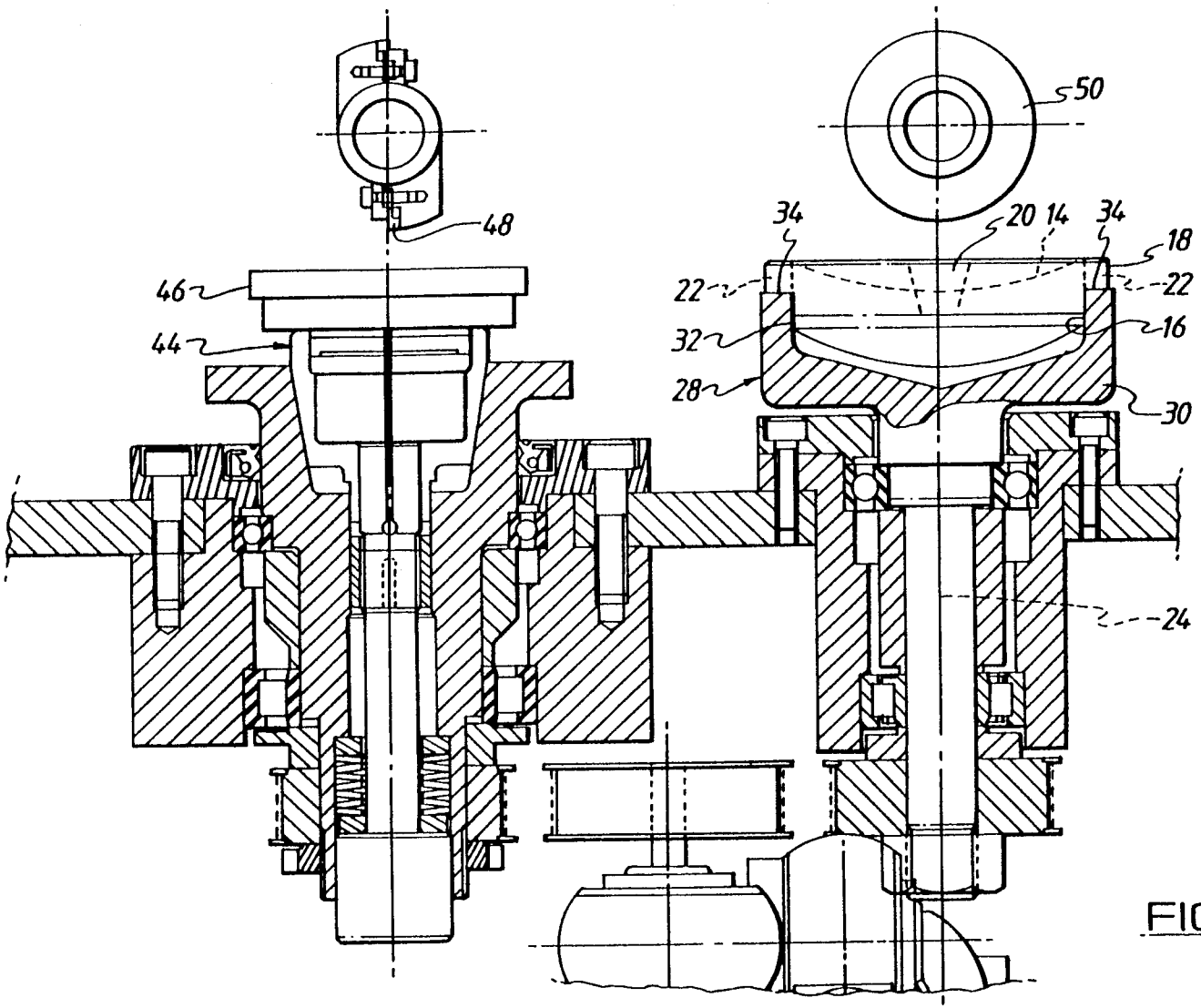
FIG. 3 is a section taken through part of a lens-grinding machine showing holders for a tool in accordance with the invention and for a lens blank.

The flange or ledge 18 with its tapered grooves 20 and 22 permits the tool to be quickly mounted on holding means 28 forming part—as shown in FIG. 3—of a lens-grinding or lens-generating machine. These holding means 28 comprise a cup-like part or nest 30 adapted to receive the lens tool in such a way that the cylindrical surface 16 of the latter opposes a corresponding cylindrical surface 32 on the cup-shaped part or rest 30. In addition, the rest 30 has four spaced-apart tapered lugs 34 which enter the grooves 20, 22 of the tool so as to drive the latter. The lugs 34 comprise two of one width and two of a different width so as to match the different widths of the grooves 20 and 22 on the tool for axis location. In this way the tool 10 is held securely, yet quickly and releasably, on the machine.

As will be seen from FIG. 3, the machine also includes a holder 44 for a blocked lens 46 which can be cut by a cutter 48 in dependence on the movement of a wheel follower 50 over the concave surface 14 of the tool 10. This operation is described in detail in GB-A-1,297,614 and will not therefore be explained further here.

Figure 4:
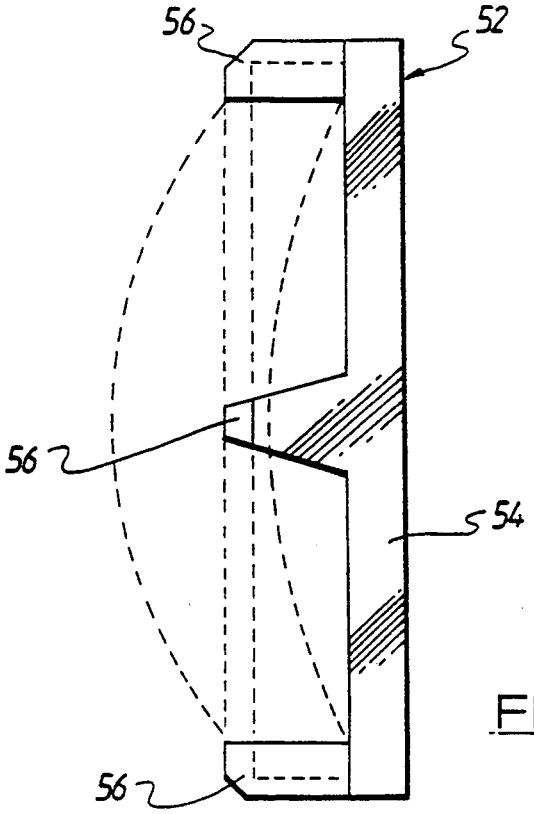
FIG. 4 is a side view of a holding element for holding the tool on a lens-polishing machine.
Figure 5:
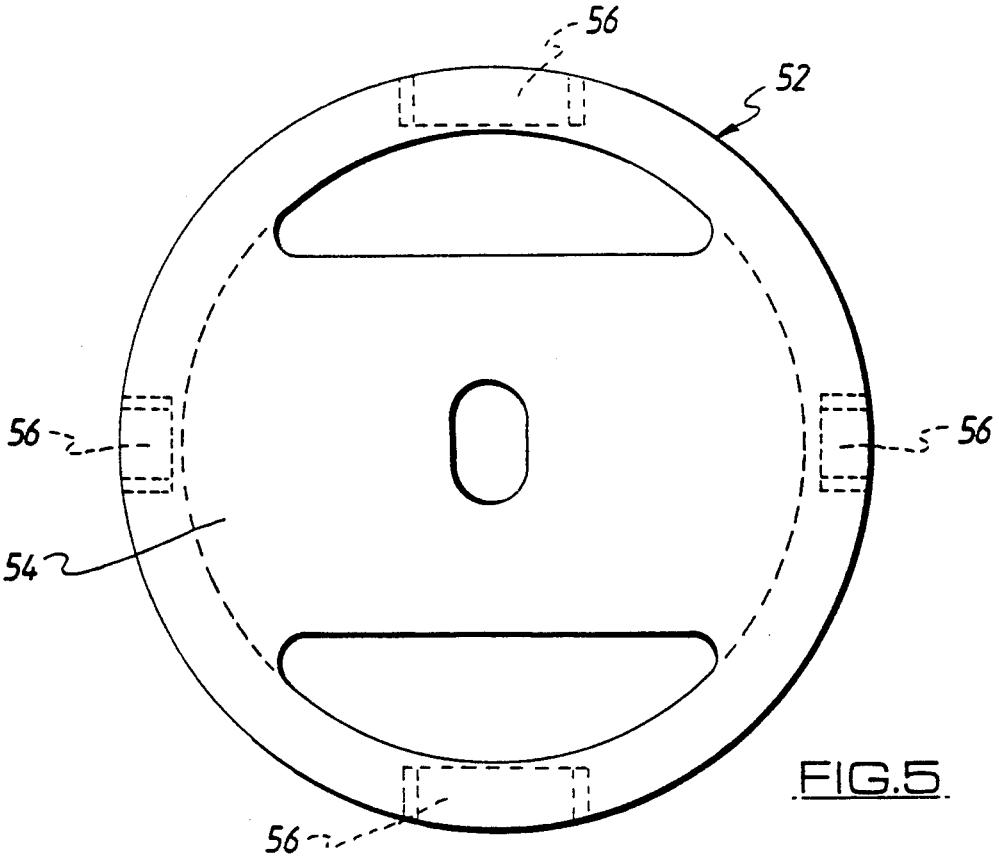
FIG. 5 is a plan view of the holding element shown in FIG. 4.

Once the tool 10 has been used to generate a surface on the lens by the machine shown in FIG. 3, the tool can then be removed therefrom and used as a polishing tool on a lens-polishing machine. FIGS. 4 and 5 show a holding element 52 which can be used to hold the tool on such a machine. As will be seen, the holding element 52 comprises a circular disc 54 with longitudinally-projecting fingers 56 of tapered form for the purpose of entering the tapered grooves 20 and 22 on the tool. This permits the tool to be held securely, yet quickly and removably, on a lens-polishing machine spindle.

I claim:

1. A lens surface former and polishing tool comprising a generally circular block of material formed symmetrically about a rotational axis of the tool, lens-generating or lens-forming surfaces on two opposite-facing sides of the block, at least one flange or ledge formed on the block and projecting radially outwards with respect to the rotational axis of the tool to act as securing means for securing the block on a lens-generating machine or a lens-polishing machine, and location grooves formed in the flange or ledge on the block, and wherein at least one of the grooves is of a different width from the other grooves so as to permit the grooves to cooperate with holding lugs of unequal width for axis location on a lens-polishing machine.

2. A lens surface former and polishing tool according to claim 1, wherein the location grooves extend longitudinally of the tool so as to be parallel to the rotational axis thereof.

3. A lens surface former and polishing tool according to claim 1, wherein the location grooves are of tapered form.

4. A lens surface former and polishing tool according to claim 1, having four location grooves, two or one width and the other two of a different width.

5. A lens surface former and polishing tool according to claim 1, wherein the radially-projecting flange or ledge is formed integrally with the block.

6. A lens surface former and polishing tool according to claim 1, wherein the block is made of aluminium, aluminium alloy or a zinc-based alloy.

7. A lens surface former and polishing tool according to claim 1, wherein the flange or ledge on the block has upper and lower surfaces which lie at right angles to the rotational axis of the tool.

8. A lens surface former and polishing tool according to claim 1, wherein one side surface of the block is convex while the other side surface is concave.

9. A tool/tool holder assembly comprising a lens surface former and polishing tool as claimed in claim 1 which is held on a tool holder, said holder being in the form of a cup-shaped part or nest which receives the lens tool in such a way that a cylindrical surface on the lens tool opposes a corresponding cylindrical surface on the cup-shaped part or nest, the cup-shaped part or nest also having spaced-apart lugs which engage in the grooves on the tool so as to drive the latter.

10. A tool/tool holder assembly comprising a lens surface former and polishing tool as claimed in claim 1 which is held on a tool holder, said holder being in the form of a disc having fingers which enter the grooves in the tool.

11. A tool/tool holder assembly comprising a lens surface former and polishing tool held on a tool holder, the lens surface former and polishing tool comprising a generally circular block of material formed symmetrically about a rotational axis of the tool, lens-generating or lens-forming surfaces on two opposite-facing sides of the block, at least one flange or ledge formed on the block and projecting radially outwards with respect to the rotational axis of the tool to act as securing means for securing the block on a lens-generating machine or a lens-polishing machine, and location grooves formed in the flange or ledge on the block, and said tool holder being in the form of a cup-shaped part or nest which receives the lens tool in such a way that a cylindrical surface on the lens tool opposes a corresponding cylindrical surface on the cup-shaped part or nest, the cup-shaped part or nest also having spaced-apart lugs which engage in the grooves on the tool so as to drive the latter.

12. A tool/tool holder assembly according to claim 11, wherein the tool has four location grooves, two of one width and the other two of a different width, and wherein the tool holder has four lugs, two of one width and two of a different width, so as to match the four grooves on the tool.

* * * * *